US006460222B2

(12) United States Patent
Je

(10) Patent No.: US 6,460,222 B2
(45) Date of Patent: Oct. 8, 2002

(54) HINGE STRUCTURE FOR BACK DOOR

(75) Inventor: Jun-Ho Je, Ulsan (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 09/881,307

(22) Filed: Jun. 13, 2001

(65) Prior Publication Data

US 2002/0066159 A1 Jun. 6, 2002

(30) Foreign Application Priority Data

Dec. 5, 2000 (KR) ..... 2000-73409

(51) Int. Cl.[7] ..... E05D 3/06
(52) U.S. Cl. ..... 16/357
(58) Field of Search ..... 16/357, 360, 361, 16/368, 369, 86 C; 296/146.11, 146.12

(56) References Cited

U.S. PATENT DOCUMENTS

| | | | | | |
|---|---|---|---|---|---|
| 1,282,435 | A | * | 10/1918 | Korb | 16/357 |
| 2,249,403 | A | * | 7/1941 | Stollsteimer | 16/357 |
| 2,823,662 | A | * | 2/1958 | Aylor | 16/357 |
| 3,673,635 | A | * | 7/1972 | Cencioni | 16/163 |
| 4,068,348 | A | * | 1/1978 | Chivers | 16/368 |
| 4,738,003 | A | * | 4/1988 | Mori et al. | 16/368 |
| 5,035,463 | A | * | 7/1991 | Kato et al. | 296/146.11 |
| 5,050,270 | A | * | 9/1991 | Burgei et al. | 16/361 |
| 5,632,065 | A | * | 5/1997 | Siladke et al. | 16/368 |
| 6,141,832 | A | * | 11/2000 | Salice | 16/369 |
| 6,347,818 | B1 | * | 2/2002 | Lyons, Sr. | 16/361 |

FOREIGN PATENT DOCUMENTS

| | | | | | |
|---|---|---|---|---|---|
| GB | 2049800 | A | * | 5/1980 | E06D/3/06 |
| GB | 2069037 | A | * | 1/1981 | E05D/3/06 |
| GB | 2070129 | A | * | 1/1981 | E05D/3/06 |

* cited by examiner

*Primary Examiner*—Robert E. Pezzuto
*Assistant Examiner*—Alexandra K. Pechhold
(74) *Attorney, Agent, or Firm*—Christie, Parker & Hale, LLP

(57) ABSTRACT

A hinge structure of back door constructed to reduce the sizes of parts comprising hinges of a back door for enabling to obtain an accommodation space, wherein, in a door hinge having a first hinge unit and a second hinge unit rotatively coupled to an inner panel of a door and to a recess of a body, each connected to a rotary axle, the hinge structure for back door comprises a guide member formed at a bottom surface thereof with a coupling hole through which to secure the first hinge unit via a bolt and a nut and formed at both left and right tip ends thereof with a bent piece having a guide hole, a bracket formed at a bottom surface thereof with a coupling hole and formed at both left and left sides thereof with bent pieces formed at one side thereof with a connecting hole, first and second rods having both ends externally expanded for being respectively inserted into the guide hole of the guide member and the connecting hole of the bracket while central units thereof ware made in "⊂" shape, a connecting member for connecting the central units of the first and second rods, and a torsion bar spring for being inserted into a tip end of the second rod and for being mounted between the bent pieces and the bracket.

3 Claims, 7 Drawing Sheets

HINGE STRUCTURE FOR BACK DOOR

CROSS-REFERENCE TO RELATED APPLICATION

This application claims priority of Korea patent Application No. 2000-73409, filed on Dec. 5, 2000.

BACKGROUND OF THE INVENTION

1. Field of the Invention

The present invention relates to a hinge structure for back door, and more particularly to a hinge structure of back door constructed to reduce the sizes of parts comprising hinges of a back door for enabling to obtain an accommodation space.

2. Description of the Prior Art

In general, a van is equipped with a door for opening and closing for loading and unloading cargoes, and the door is mounted with hinges for opening and closing the door by way of turning to the left and right directions.

In other words, the door is installed with hinges 10 and 10' where the hinges 10 and 10' function as rotating axles for opening and closing the door as illustrated in FIG. 1.

Particularly, the hinge 10 mounted at an upper part of the door 1 includes a fixation member 17 secured to an inner panel 3 of the door 1 and having a check rod 12 and a check guide 14 fixed to a recess 4 of body panel 2, as illustrated in FIG. 2.

The check rod 12 is coupled at one side thereof via a rotary pin 13 of the fixation member 17 for rotation while the other side thereof is mounted with a roller 11 for rotation.

The check guide 14 has a guide piece 15 at both left and right sides thereof for guiding the roller 11 of the check rod 12 while a tip end thereof is formed with a bent stopper 16 for holding the roller 11.

Coupling holes (not shown) are respectively formed on the fixation member 17 and the check guide 14 where the fixation member 17 is coupled o an inner panel 3 of the door 1 while the check guide 14 is coupled to a recess 4 of the body 2 therethrough via a nut and a bolt.

As shown in FIG. 4*b*, when the door 1 is to be opened, the roller 11 at the check rod 12 moves along an upper end of the guide piece 15 at the check guide 14, and when the roller 11 is received by the stopper 16, the door 1 is completed in opening to a 180 degree. When the door 1 is to be closed, the roller 11 is guided via the guide piece 15 to cause the door to be closed in the reverse way, as illustrated in FIG. 4*a*.

Meanwhile, the hinge 10' mounted underneath the door 1 includes a first hinge unit 11' secured to an inner panel 3 of the door 1 and a second hinge unit 12' fixed to the recess 4 of the body panel 2, as illustrated in FIG. 3.

The first hinge unit 11' is made to rotate by being coupled via a rotary pin 13' on the second hinge unit 12', while coupling holes are respectively formed on the first and second hinge units 11' and 12' where the first hinge unit 11' is coupled to the inner panel 3 of the door 1 whilst the second hinge unit 12' is secured to the recess 4 of the body 2 therethrough via a bolt 14' and a nut 15', such that, when the door is to be opened, the door is rotated outwardly about the rotary pin 13' to thereby be opened.

Furthermore, when the door is to be closed, the door performs the reverse operation about the rotary pin 13' to thereby be closed.

However, there is a problem in hinge structure for back door thus constructed according to the prior art in that the check rod mounted on the door for opening and closing to the left and right directions is too large in radius of gyration thereof to possess needless space toward the external side of the door while the recess of the body is formed with a space where the check rod is inserted such that, in constructing the recess, the manufacturing process becomes too much complicated to make assembling work difficult.

There is another problem in that the check guide, being burdened with the guide piece for guiding the check rod, takes up too much space to secure same to the body, thereby increasing the number of assembling processes in performing the coupling words for cooperating with check rod.

There is still another problem in that manufacturing process of parts is complicated to consume extra amount of manufacturing cost.

SUMMARY OF THE INVENTION

The present invention is disclosed to solve the aforementioned problems and it is an object of the present invention to provide a hinge structure for back door constructed to reduce the number of parts comprising a hinge of a door, manufacturing processes and manufacturing cost.

In accordance with the object of the present invention, there is provided a hinge structure for back door, the structure comprising:

- a guide member secured to a first hinge unit for performing rotation when the door is opened and closed;
- a first rod guided along the guide member;
- a second rod extensively connected with the first rod; and
- a bracket where the second rod is coupled while being secured to a second hinge unit.

BRIEF DESCRIPTION OF THE DRAWINGS

For fuller understanding of the nature and objects of the invention, reference should be made to the following detailed description taken in conjunction with the accompanying drawings in which.

DETAILED DESCRIPTION OF THE INVENTION

Now, preferred embodiment of the present invention will be described in detail with reference to the accompanying drawings.

Figure 1:
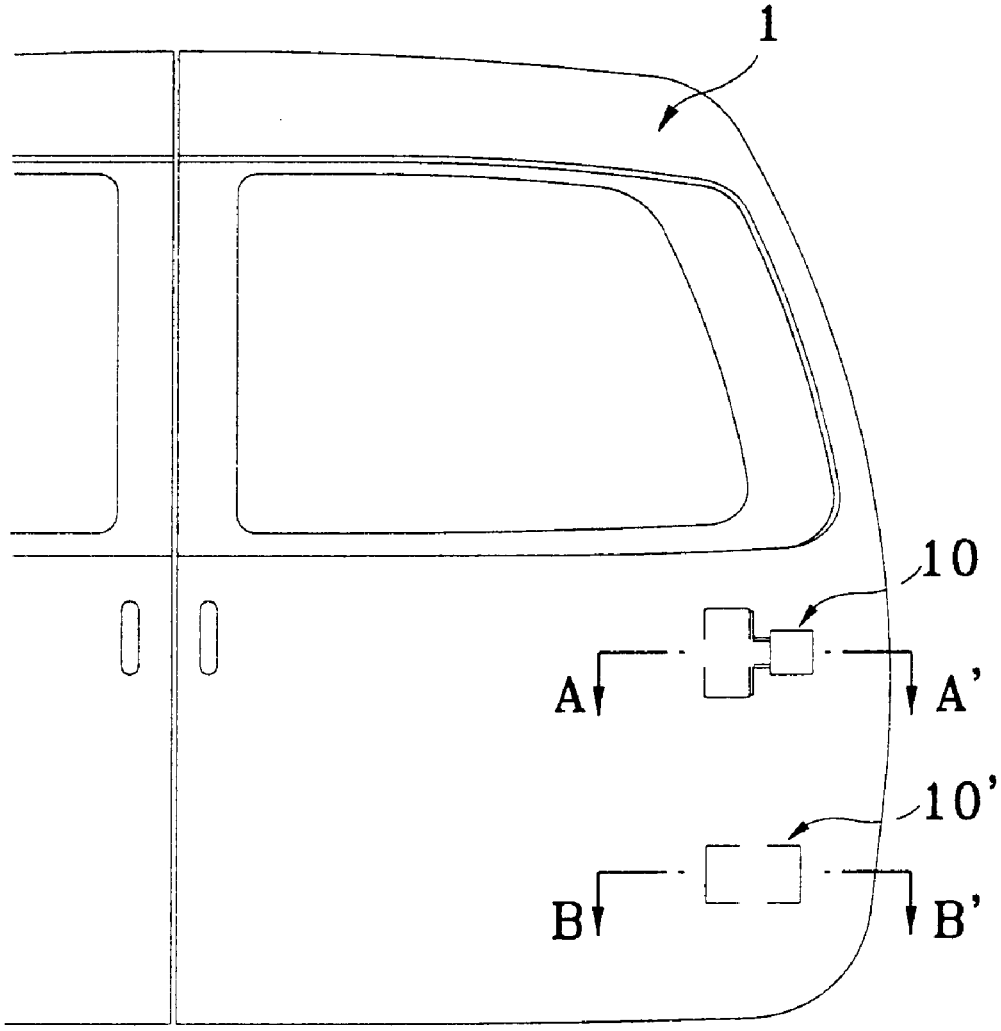
FIG.1 (Prior art)
FIG. 1 is a rear view for illustrating an installed position of a back door hinge according to the prior art.
Figure 2:
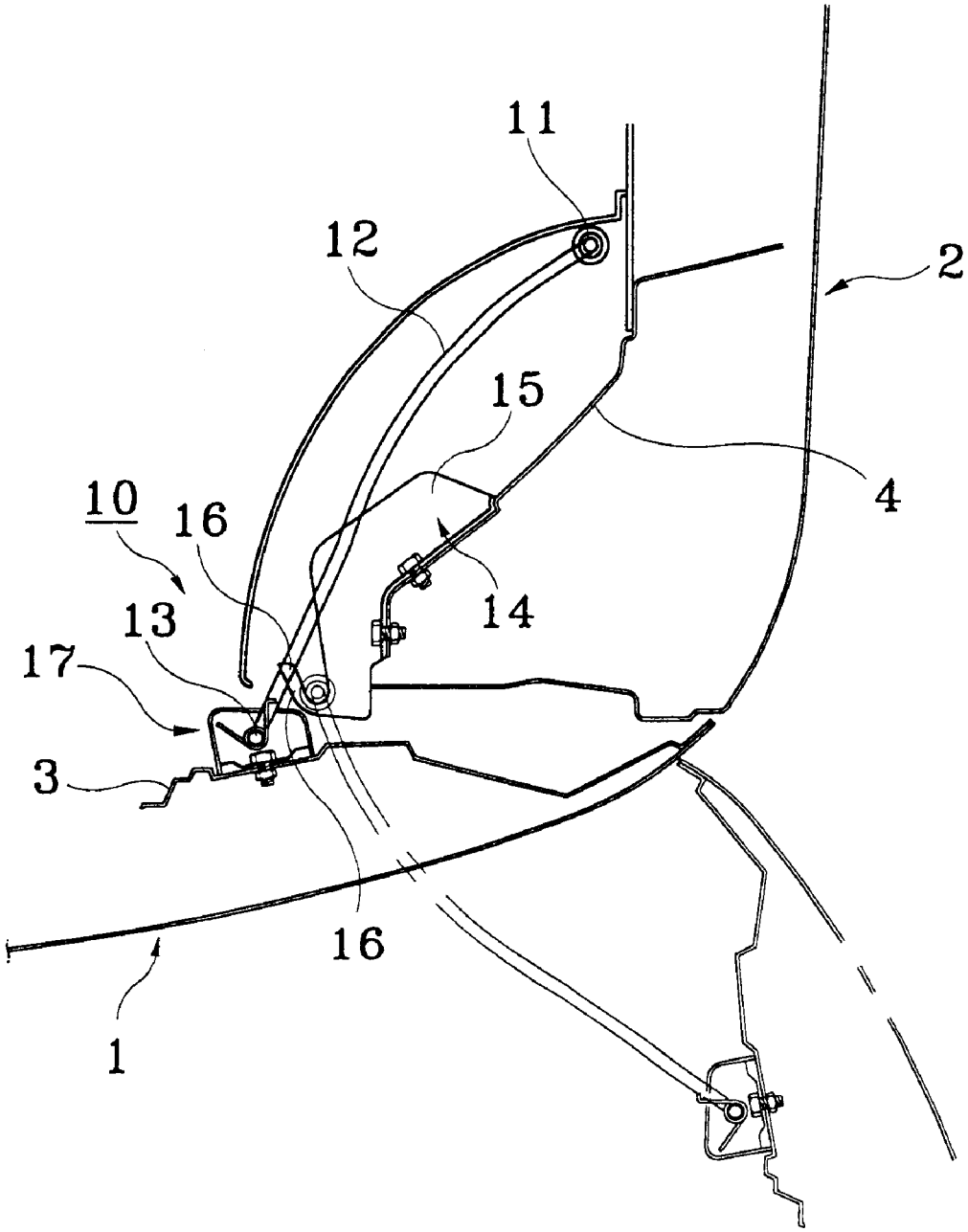
FIG.2 (Prior art)
FIG. 2 is a sectional view taken along line A–A' of FIG. 1.
Figure 3:
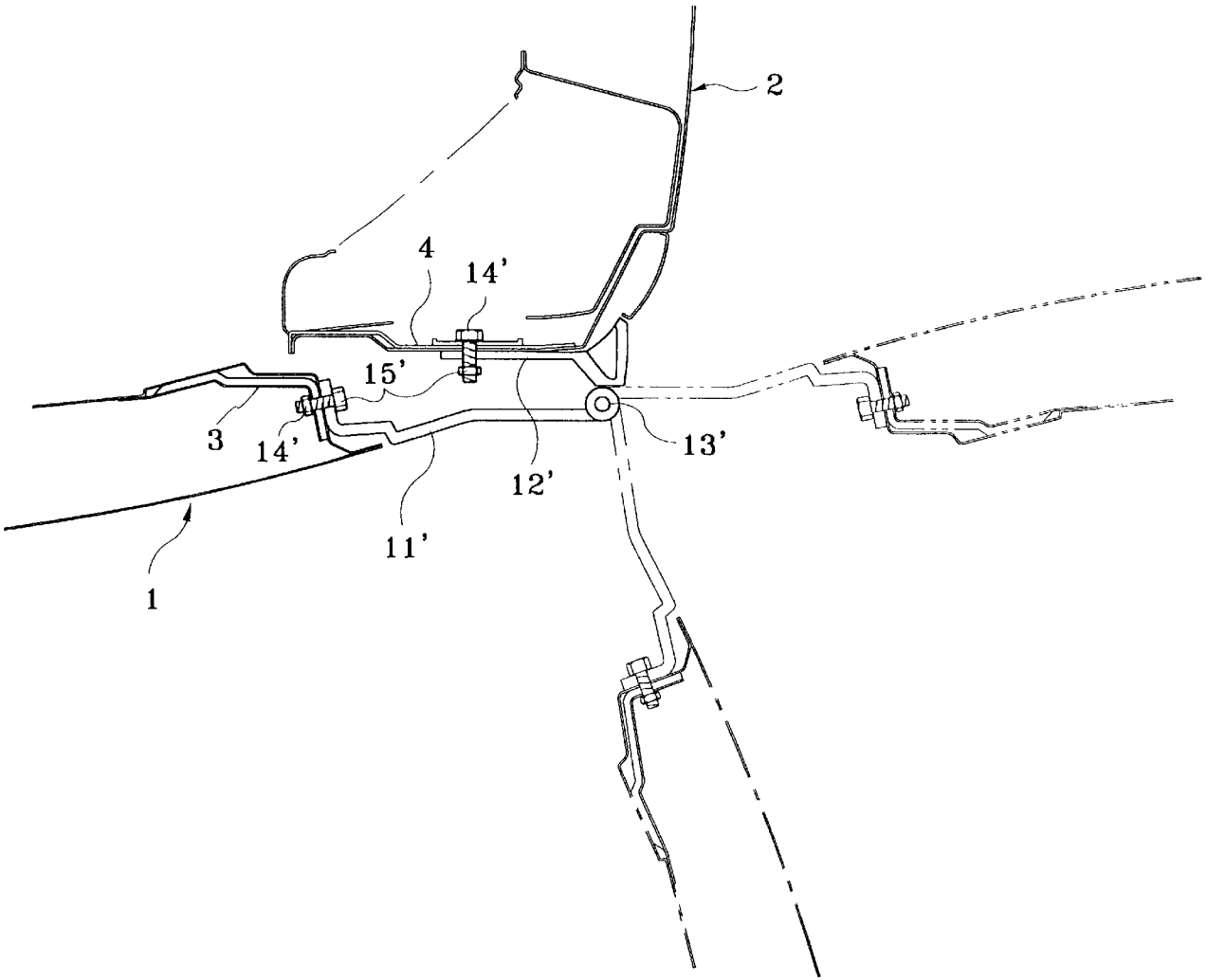
FIG.3 (Prior art)
FIG. 3 is a sectional view taken along line B–B' of FIG. 1.
Figure 4A:
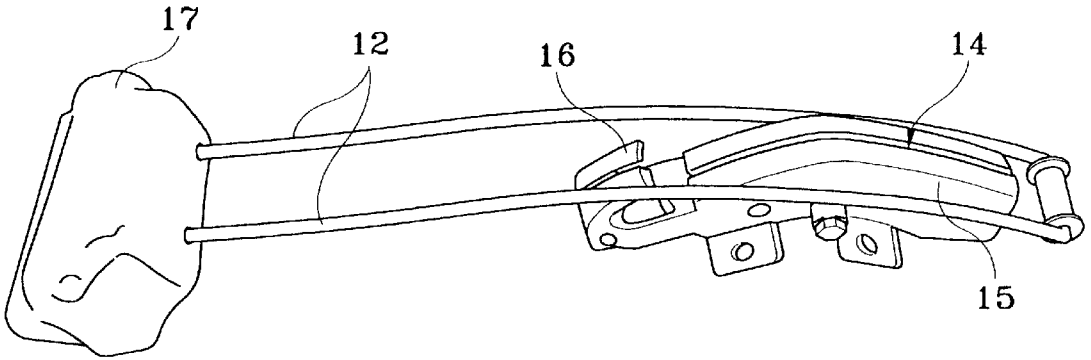
FIG.4a (Prior art)
FIG. 4*a* is a perspective view for illustrating a hinge structure when a door in FIG. 2 is closed.
Figure 4B:
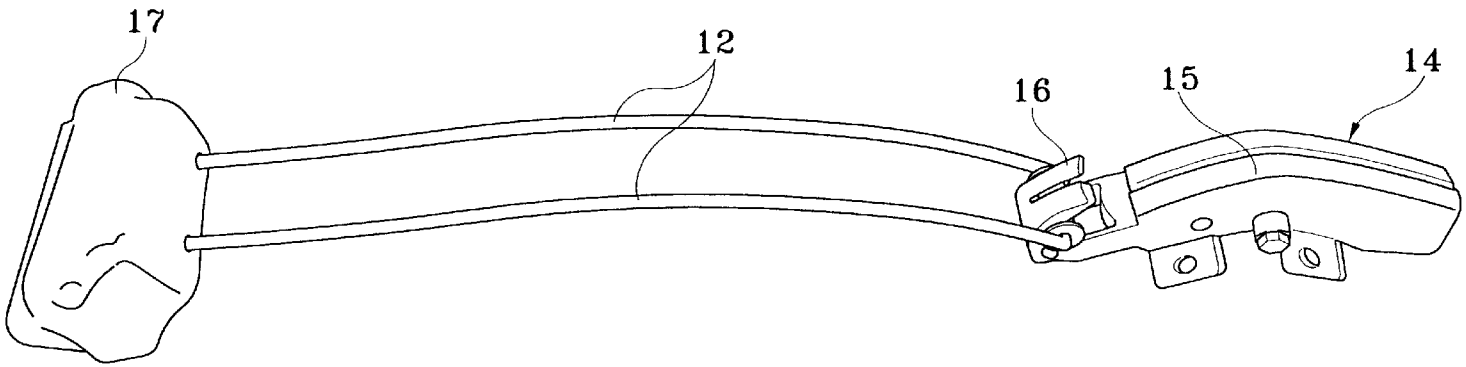
FIG.4b (Prior art)
FIG. 4*b* is a perspective view for illustrating a hinge structure when a door in FIG. 2 is opened.
Figure 5:
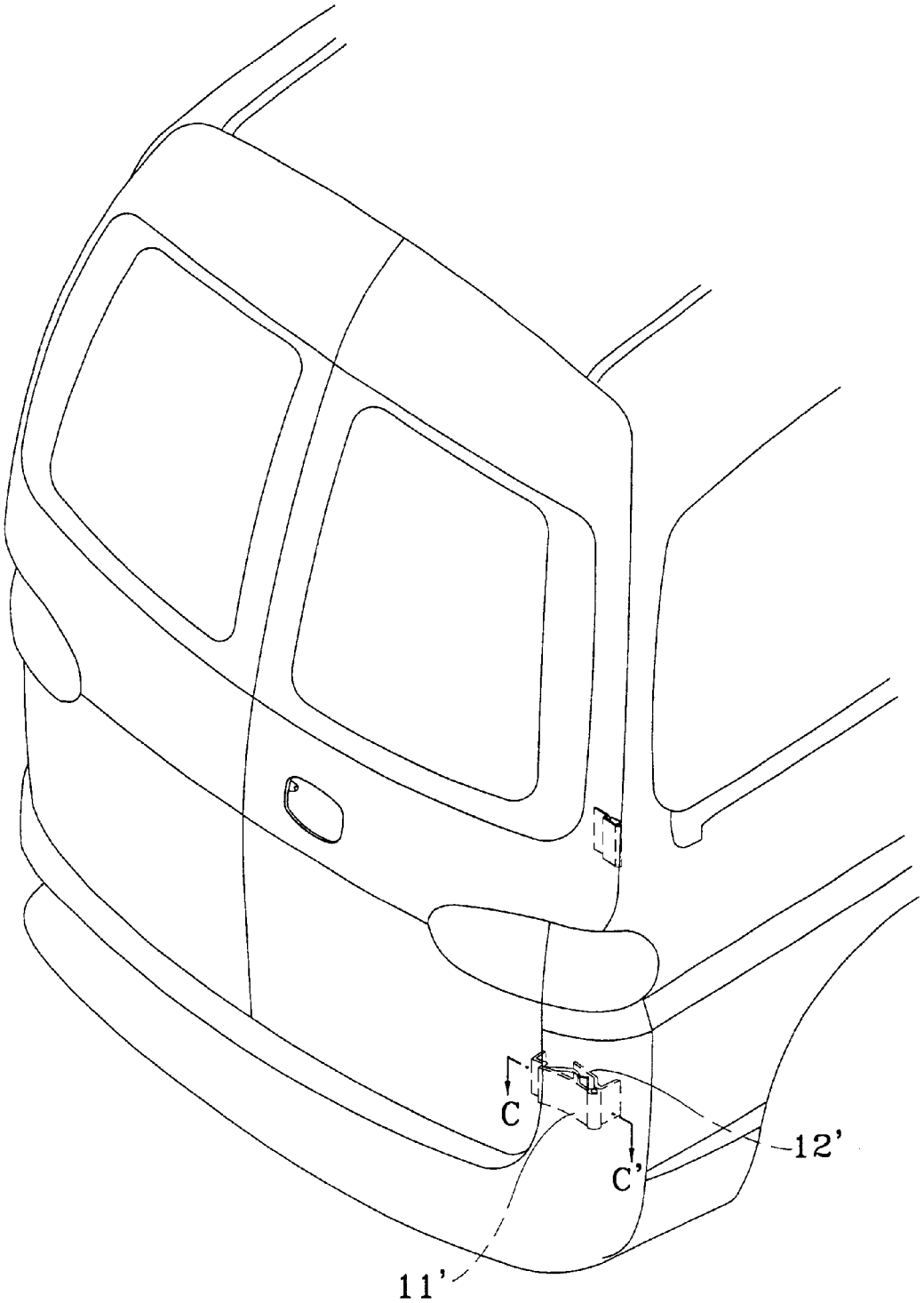
FIG. 5 is a perspective view for illustrating an installed statue where a hinge according to the present invention is mounted to a door.
Figure 6:
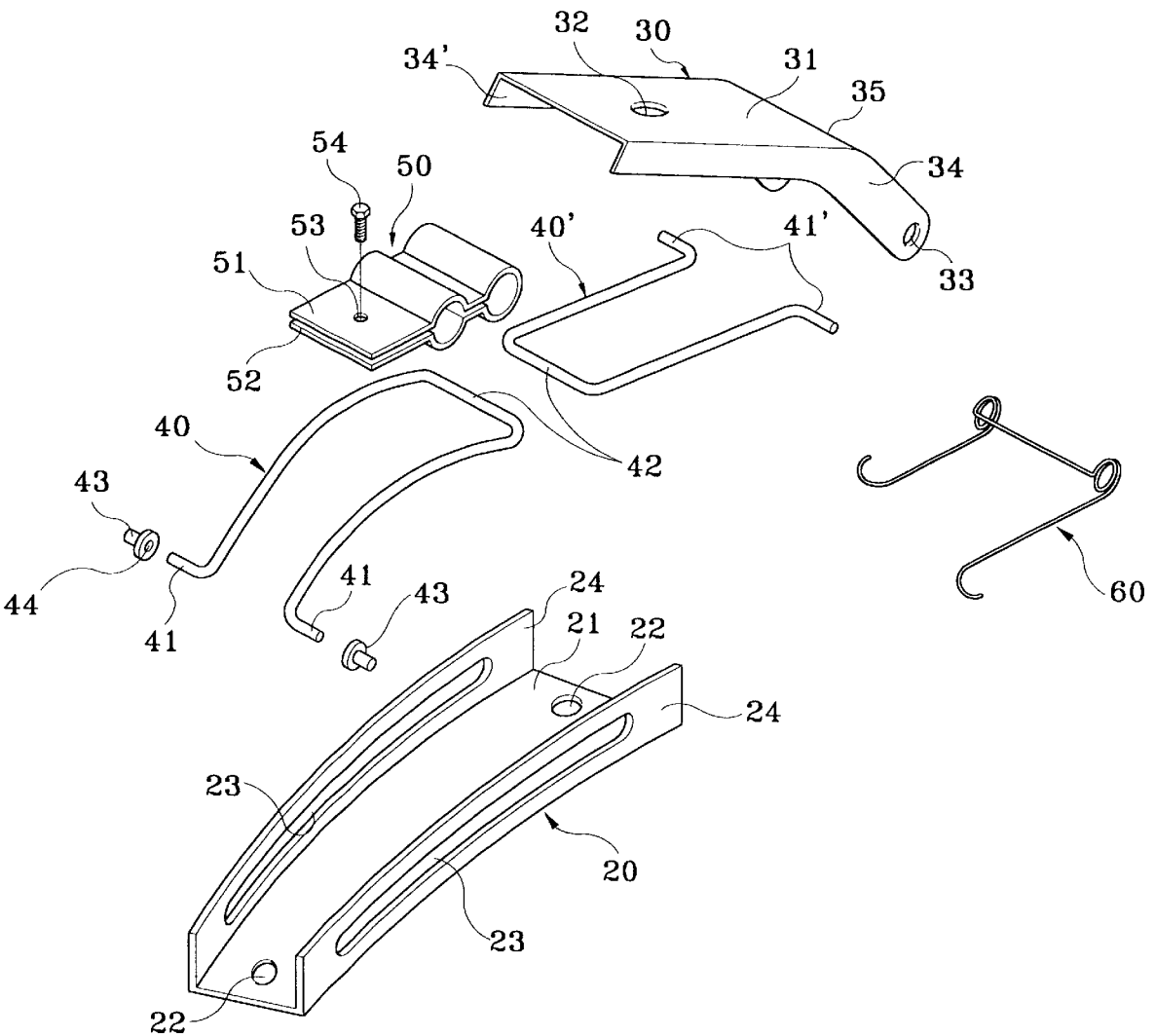
FIG. 6 is an exploded perspective view for illustrating a hinge structure according to the present invention.
Figure 7:
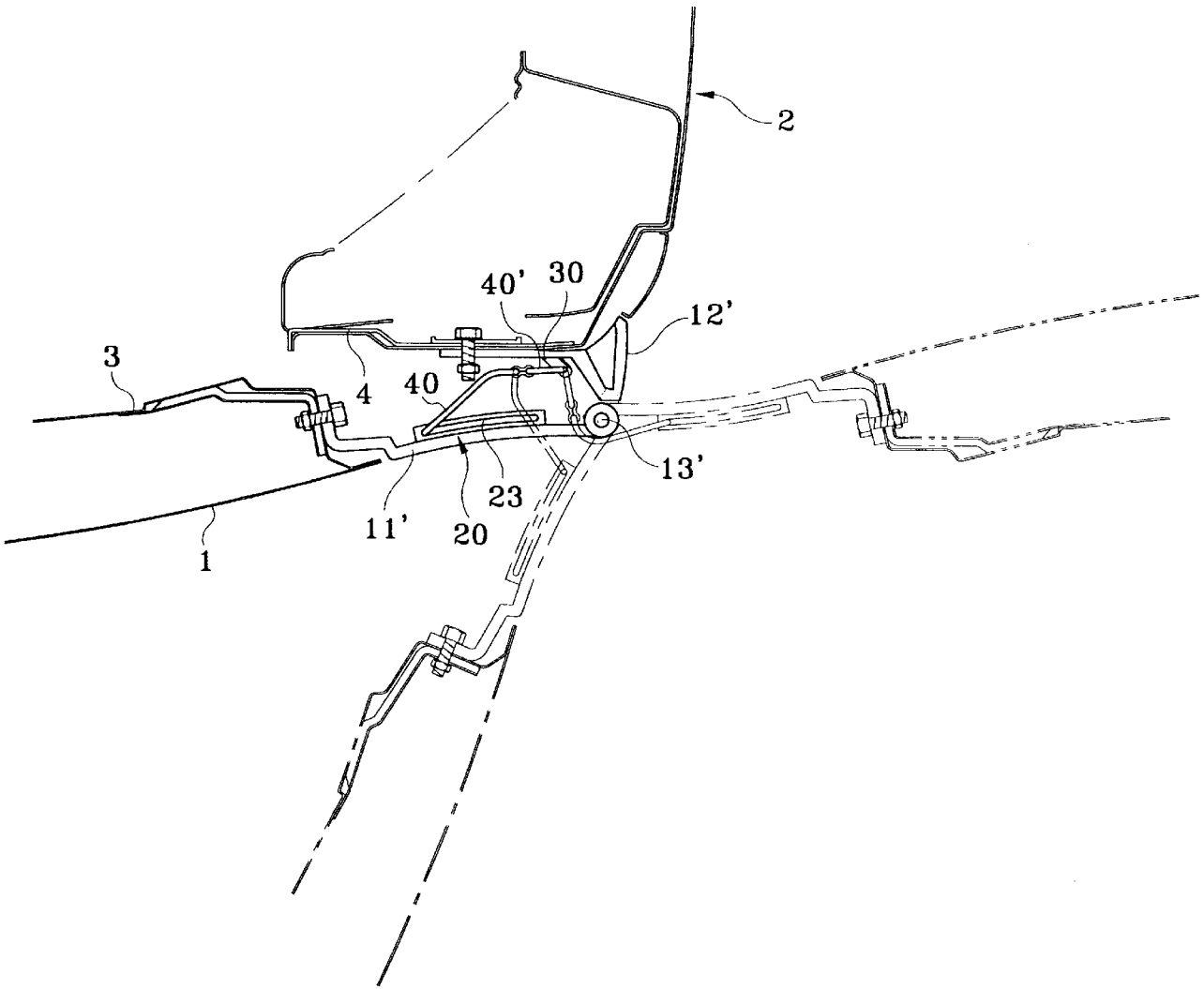
FIG. 7 is a sectional view taken along line C–C' of FIG. 5.

FIGS. 6 and 7 are respectively an exploded perspective view of a hinge structure according to the present invention and a sectional view for illustrating an operational state of the hinge structure.

In a door hinge 10' having a first hinge unit 11, and a second hinge unit 12' rotatively coupled to an inner panel 3 of a door 1 and to a recess 4 of a body 2, each connected to a rotary axle 13', the hinge structure for back door comprises a guide member 20 formed at a bottom surface 21 thereof with a coupling hole 22 through which to secure the first hinge unit 11' via a bolt and a nut and formed at both left and right tip ends thereof with a bent piece 24 having a guide hole 23, a bracket formed at a bottom surface 31 thereof with a coupling hole 32 and formed at both left and right sides thereof with bent pieces 34 and 34' formed at one side thereof with a connecting hole 33, first and second rods 40 and 40' having both ends 41 and 41' externally expanded for being respectively inserted into the guide hole 23 of the guide member 20 and the connecting hole 33 of the bracket 30 which central units thereof 42 and 42' are made in "⊂" shape, a connecting member 50 for connecting the central units 42 and 42' of the first and second rods 40 and 40', and a torsion bar spring 60 for being inserted into a tip end 41' of the second rod 40' and for being mount ed between the bent pieces 34 and 34' of the bracket 30.

The connecting member 50 includes a front unit 51 and a rear unit 52, where the front unit 51 and the rear unit 52 are detached from each other. The front unit 51 and the rear unit 52 are integrally connected by a side having an oval shape in cross-sectional view while the other side thereof is opened.

As a result, the connecting member 50 has a cross-sectional shape of hollowed dumbbell, and the front and rear units 51 and 52 are oppositely formed at the other side thereof with fixation holes 53 through which the front unit 51 and the rear unit 52 are integrally joined via fixation bolt 54. It is preferred that central axles of the fixation holes are corresponded.

Furthermore, the connecting member 50 may be formed by simply pressing a predetermined size of steel plate and punching thereto. The bracket 30 is inclined and bent at a right tip end 35 thereof on the basis of a bottom surface 310 The f first rod 40 is curved while its tip end 41 is mounted with a guide rod 43 formed with a coupling hole 44 for insertion therethrough and having a cross-sectional shape of a hat.

Now, operational state of the hinge thus constructed according to the present invention will be described.

When the door 1 is to be opened and while the second rod 40' is abutted to the bracket 30 by resilience of the torsion bar spring 60, the guide hole 23 is guided and moved by the tip end 41 of the first rod 40 in response to movement of the guide member 20 upto approximately 90 degrees when the door rotates the rotary axle 13' to an axle, enabling the door 1 to rotate.

After the tip end 41 of the first rod 40 reaches a far end of the guide hole 23 by the relative movement of the guide hole 23 and the first rod 40 to thereby stop further relative movement, turning effect of the door 1 is transmitted to the second rod 40' through the guide member 20, first rod 40 and he connecting member 50 where the second rod 40' overcome the resilience of the torsion bar spring 60 and is rotated, such that the door is rotated upto approximately 180degrees to thereby be opened.

Meanwhile, when the door 1 is to be closed, the second rod 40' is rotated toward the bracket 30 by the operation of the torsion bar spring 60 to absorb rotating angle of the door 1, and successively the door 1 is rotated until the second rod 40' completely contacts the bracket 30, where the guide hole 23 at the guide member 20 is guided and moved by the tip end of the first rod 40 to close the door 1.

As apparent from the foregoing, there is an advantage in the hinge structure for back door thus described according to the present invention in that a hinge of the prior art is simply constructed in reduced sizes of parts to enable to save the number of working processes and to decrease the manufacturing cost according to the reduced sizes of the parts.

What is claimed is:

1. A hinge structure for back door, wherein, in a door hinge having a first hinge unit and a second hinge unit rotatively coupled to an inner panel of a door and to a recess of a body, each connected to a rotary axle, the hinge structure for back door comprises a guide member formed at a bottom surface thereof with a coupling hole through which to secure the first hinge unit via a bolt and a nut and formed at both left and right tip ends thereof with a bent piece having a guide hole, a bracket formed at a bottom surface thereof with a coupling hole and formed at both left and left sides thereof with bent pieces formed at one side thereof with a connecting hole, first and second rods having both ends externally expanded for being respectively inserted into the guide hole of the guide member and the connecting hole of the bracket while central units thereof are made in "⊂" shape, a connecting member for connecting the central units of the first and second rods, and a torsion bar spring for being inserted into a tip end of the second rod and for being mounted between the bent pieces and the bracket.

2. The structure as defined in claim 1, wherein the connecting member comprises a front unit and a rear unit, each detached therebetween while the front unit and the rear unit are integrally connected at upper sides thereof, with a cross-sectional view of hollowed dumbbell shape, and with a lower side thereof respectively formed with fixation holes.

3. The structure as defined in claim 1, wherein the bracket is inclined and bent at a right tip end thereof on the basis of a bottom surface.

* * * * *